US006427695B1

(12) United States Patent
Zanetti et al.

(10) Patent No.: US 6,427,695 B1
(45) Date of Patent: Aug. 6, 2002

(54) BACK PROTECTION SHIELD

(75) Inventors: Pietro Zanetti, Montebello; Gianni Zago, San Quirino, both of (IT)

(73) Assignee: Spidt Sport S.r.l., Sarego (IT)

( * ) Notice: Subject to any disclaimer, the term of this patent is extended or adjusted under 35 U.S.C. 154(b) by 0 days.

(21) Appl. No.: 09/614,561

(22) Filed: Jul. 12, 2000

(30) Foreign Application Priority Data

Sep. 10, 1999 (IT) ..... VR9900004 U

(51) Int. Cl.[7] ..... A61F 13/00
(52) U.S. Cl. ..... 128/846; 128/869; 128/870
(58) Field of Search ..... 128/845, 846, 128/869, 870; 2/16; 602/5, 19

(56) References Cited

U.S. PATENT DOCUMENTS 5,065,457 A * 11/1991 Henson ..... 2/16
5,140,995 A * 8/1992 Uhl ..... 128/846
5,328,447 A * 7/1994 Kapounek ..... 602/19
5,586,561 A * 12/1996 Archer ..... 128/846

* cited by examiner

*Primary Examiner*—Michael A. Brown
(74) *Attorney, Agent, or Firm*—Guido Modiano; Albert Josif; Daniel O'Byrne

(57) ABSTRACT

A back protection shield, which includes at least one anatomic shell-like body made of substantially rigid material and longer than wider, so as to extend longitudinally and cover a substantial portion of user's backbone. The shield has a concave inner surface designed to face, in use, the user's back and a convex outer surface and at least one series of spaced stiffening ribs which extend at least partly in a transverse direction.

16 Claims, 4 Drawing Sheets

BACK PROTECTION SHIELD

BACKGROUND OF THE INVENTION

The present invention relates to a back protection shield, particularly for motorcyclists and cyclists.

As known, garments designed to protect the backbone in case of falls from motorcycles or bicycles have already been commercially proposed and usually comprise a shield made of semirigid material which extends longitudinally and is so shaped as to cover the entire spinal area of the user's back.

In some kinds of protection device, the shield as a whole comprises two separate sectors which are hinged to one another at the level of the lumbar region by means of a mechanical articulation which allows the two sectors to perform mutual angular strokes about a pivoting axis extending perpendicularly to the shield. The two sectors are constituted, in turn, by a flexible backing layer made of textile material which acts as a support for a plurality of modular elements sequentially assembled on said backing layer. The modular elements partly overlap over one another and are hinged at the lower edge thereof along hinging lines which extend transversely with respect to the flexible backing layer, whereby performing angular raising and lowering movements with respect to said backing layer to make it possible for the shield to yield and follow the natural movements of the user's back.

The shield usually has a linear profile having an increasing width in a longitudinal direction starting from the cervical region down to a maximum value at the lumbar region and then getting narrower again at the sacral region of the user's backbone.

The modular elements forming the shield have different dimensions according to the position they occupy in the overall assembly and comprise a raised portion acting as a protective shell and a recessed flat portion which acts as a sliding surface for a partly overlapping adjacent element.

The flexible backing layer is usually covered by a padding to which two shoulder straps are applied. At the lumbar area two lateral bands are provided, the lateral bands having a tear-away closing system at their end and being designed to close around the user's hips.

The back protection shield described above, even though it is a quite valid device for protecting the user's backbone, has some drawbacks mainly due to complexity of its structure, also in view of the large number of components, e.g. the modular elements, to be assembled.

Another drawback of the commercially available model is linked to the fact that it constitutes a barrier for perspiration, since it is usually formed by modular elements filled with plastic material, which stick to the user's back thereby reducing air circulation and thus causing abundant sweating.

SUMMARY OF THE INVENTION

The main object of the present invention is to eliminate or substantially reduce the above mentioned drawbacks faced when using currently is commercially available protection devices, by providing a back protection shield which ensures a high cushioning potential upon collision in case of falls, while having a flexible and lightweight structure designed to ensure good perspiration and thus a high level of comfort.

Another object of the present invention is to provide an accessory for sports clothing which can be inserted in sports jackets or suits, thereby ensuring easy wearability and high freedom of movement for the user.

A further object of the present invention is to provide a protective shield of simple construction and reduced overall dimensions, so as to be comfortable to wear and aesthetically agreeable.

These and other objects that will become better apparent hereinafter are achieved by a back protection shield comprising at least one anatomic shell-like body of substantially rigid material longitudinally extending so as to cover, in use, a substantial portion of a user's backbone and having a concave inner surface designed to face the user's back and a convex outer surface, and at least one series of stiffening ribs spaced from one another and at least partly extending in a transverse direction.

Advantageously, said shield has a plurality of lightening and perspiration openings.

Conveniently, said lightening and perspiration openings are aligned along a longitudinal median portion of said shield.

BRIEF DESCRIPTION OF THE DRAWINGS

The present invention is further described hereinafter with reference to the accompanying drawings, wherein.

DESCRIPTION OF THE PREFERRED EMBODIMENTS

Figure 3:
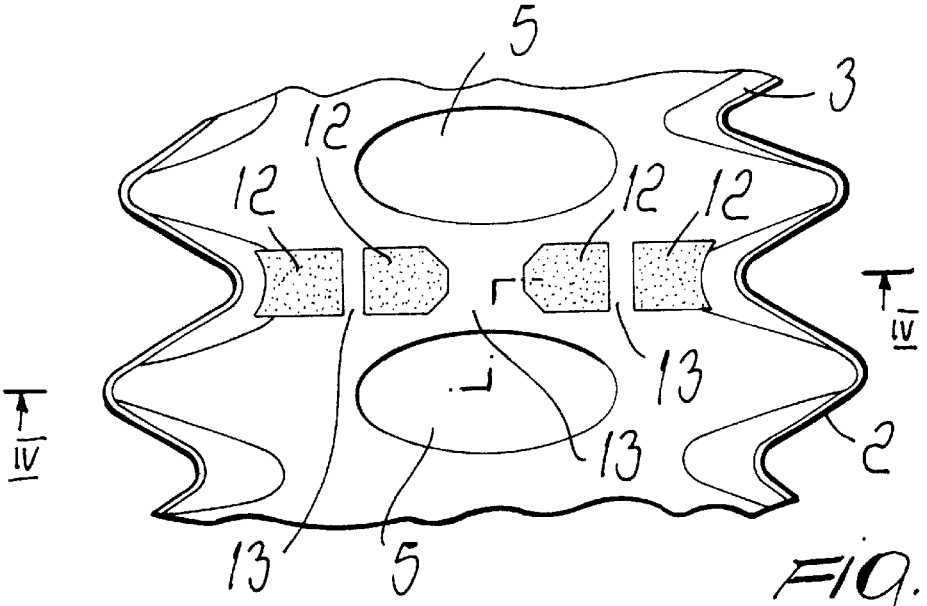
FIG. 3 illustrates a partial view of a weakening portion between two sectors of the shield of FIG. 2.

In the accompanying drawings, identical or similar parts or components have been designated by the same reference numerals.

Figure 1:
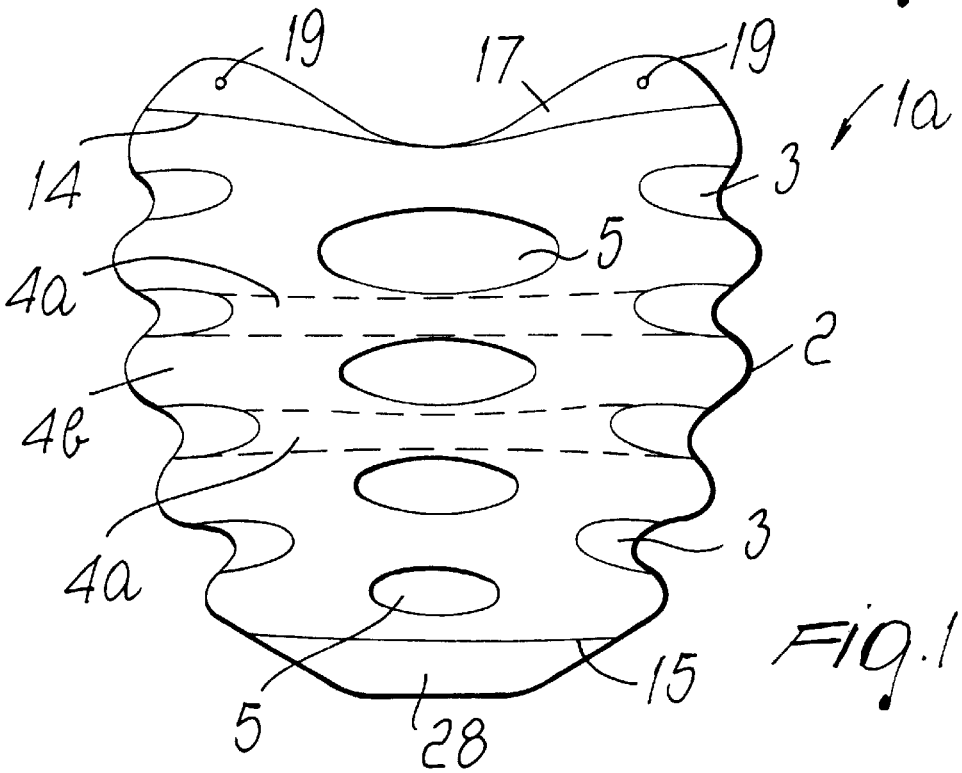
FIG. 1 is a front view of the simplest embodiment of back protection shield according to the present invention.
Figure 4:
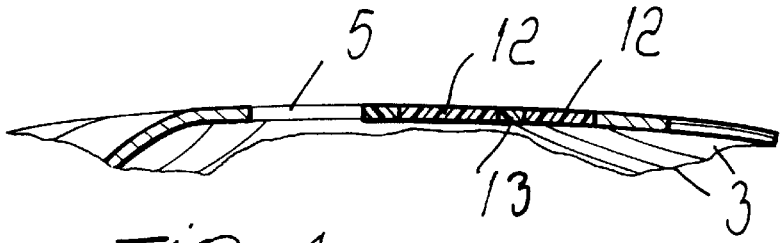
FIG. 4 shows a cross-section view taken along the line IV—IV of the shield of FIG. 3.
Figure 2:
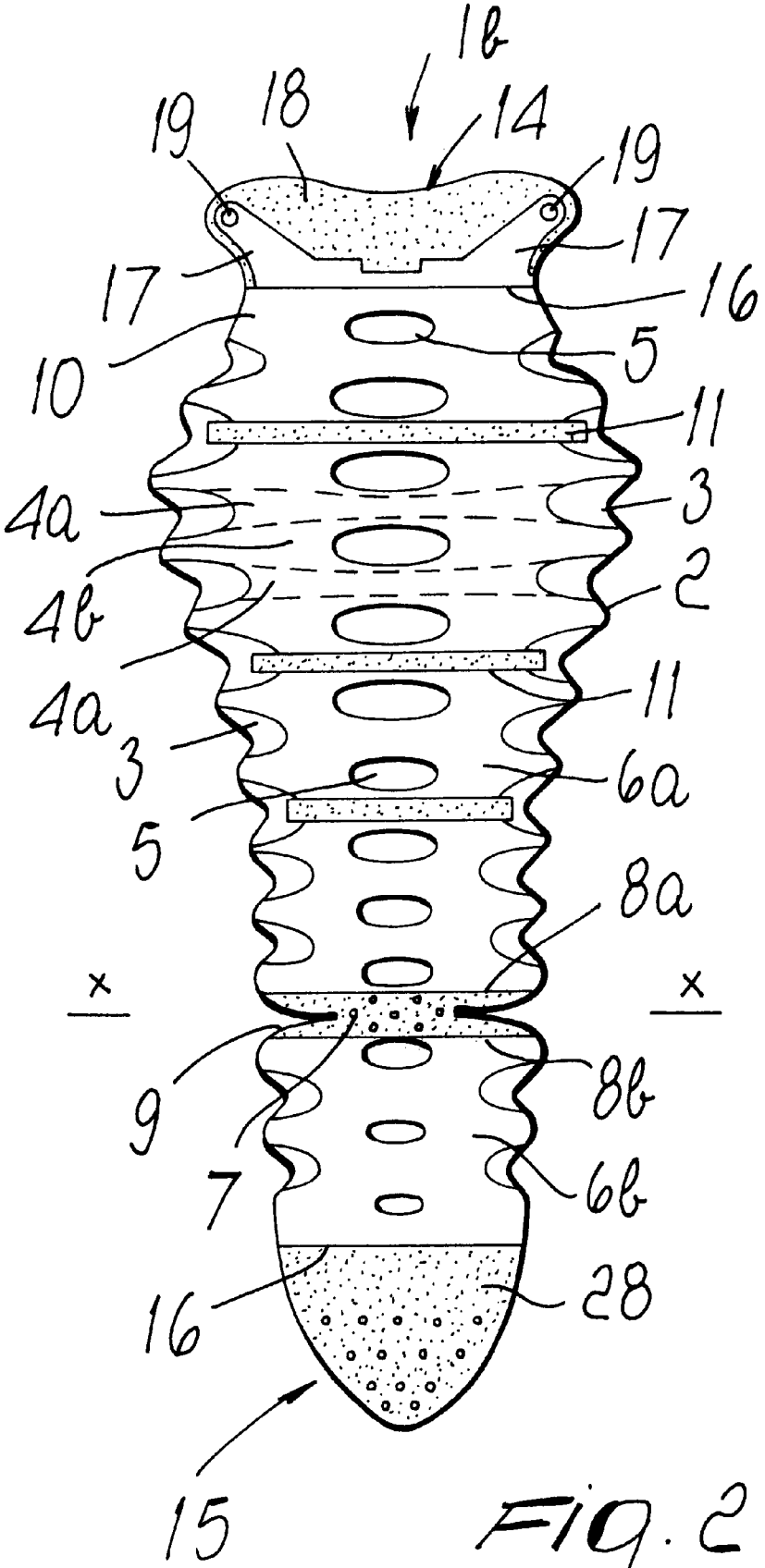
FIG. 2 shows a front view of a further embodiment of back protection shield.

With reference first to FIGS. 1 and 2, a back protection shield according to the invention is constituted by a shell-like body or element 1*a* made of a substantially rigid material which is considerably longer than wider and is designed to protect the spinal region of the user's back upon impacts due to falls from two-wheeled vehicles.

The lateral edges of the element 1*a* have a plurality of ribs 3 which are in relief with respect to the inner surface and recessed with respect to the outer surface thereof. The ribs form, in pairs, transverse reinforced portions 4*a* which are equidistant and alternated with respect to non-reinforced portions 4*b*.

The ribs 3 provided at the edge of the element 1*a* delimit a series of uniform and equidistant depressions with respect to the outer surface and act as resting points on the user's back for the element 1*a* and give their lateral edges 2 an undulating profile.

Moreover, at the median longitudinal portion of element 1*a*, holes 5 are formed having an elliptical configuration whose major axis extends transversely to the element 1*a*.

Each hole 5 is formed between two reinforced portions 4*a* and its dimensions are preferably directly proportional to the width of the element 1*a* in the section in which it is provided.

The element 1*a* can have an anatomic silhouette with a characteristic transverse widening at the scapular portion of the back, thereby protecting a larger portion thereof, since said portion is particularly exposed in case of falls from motorcycles or bicycles.

The element 1*b* is a more complex version of the element 1*a*, since it comprises two separate sections 6*a* and 6*b* which are joined to one another by means of a hinge-like joint 7 which allows them to perform angular movements about a transverse pivoting axis x—x.

The hinge-like joint 7 is obtained e.g. by means of an overinjection molding of rubber-like material that joins longitudinal ends 8*a* and 8*b* of respective sections 6*a* and 6*b*.

At the hinge-like joint 7, the profile 2 of the element 1*b* can be tapering at 9 symmetrically with respect to the longitudinal axis, thereby allowing the sectors 6*a* and 6*b* to perform slight straight or angular movements through various angles even about axes which are incident to the axis x—x.

The sector 6*a* of element 1*b* can in turn be divided, in a longitudinal direction, into a sequence of portions 10 made of substantially rigid material which are connected by a weakening portion 11.

Preferably, the weakening regions 11 have slots 12 into which resilient material is injected. The slots are alternated with portions 13 of the same substantially rigid material as that forming the portions 10.

The substantially rigid material, of which the entire element 1*a* and the individual portions 10 of the element 1*b* are made, can be e.g. a plastic material, such as PVC (polyvinilchloride), whereas the flexible material injection-molded in the weakening portions 11 is preferably rubber.

Moreover, the weakened transverse portions 11 are mutually spaced from one another so as to allow the upper sector 6*a* of the element 1*b* to yield elastically in order to adapt itself to the bending movements of the user's backbone.

The regions 11 weakened by the provision of slots 12 are formed at the reinforced portions 4*a* in order not to affect the overall rigidity of the element 1*b*.

At its upper end 14 and at its lower end 15, element 1*b* has an anatomic transverse end rib 16 which constitutes, in use, an end support, thereby forming an impact cushioning gap between back and element 1*b*.

The upper end 14 extends beyond the transverse rib 16 with two tabs 17 which diverge with respect to the longitudinal axis of the element 1*b* and on which a cervical rubber pad 18 is fixed, e.g. by electric welding.

The rubber pad 18, besides making the protective device 1*b* more comfortable, is also designed to cushion impacts against the cervical region.

Each one of the two tabs 17 can be formed with a hole 19 both whether the element 1*b* is supported by a harness 20 or it is inserted and fixed inside a jacket or a sports suit.

Figure 5:
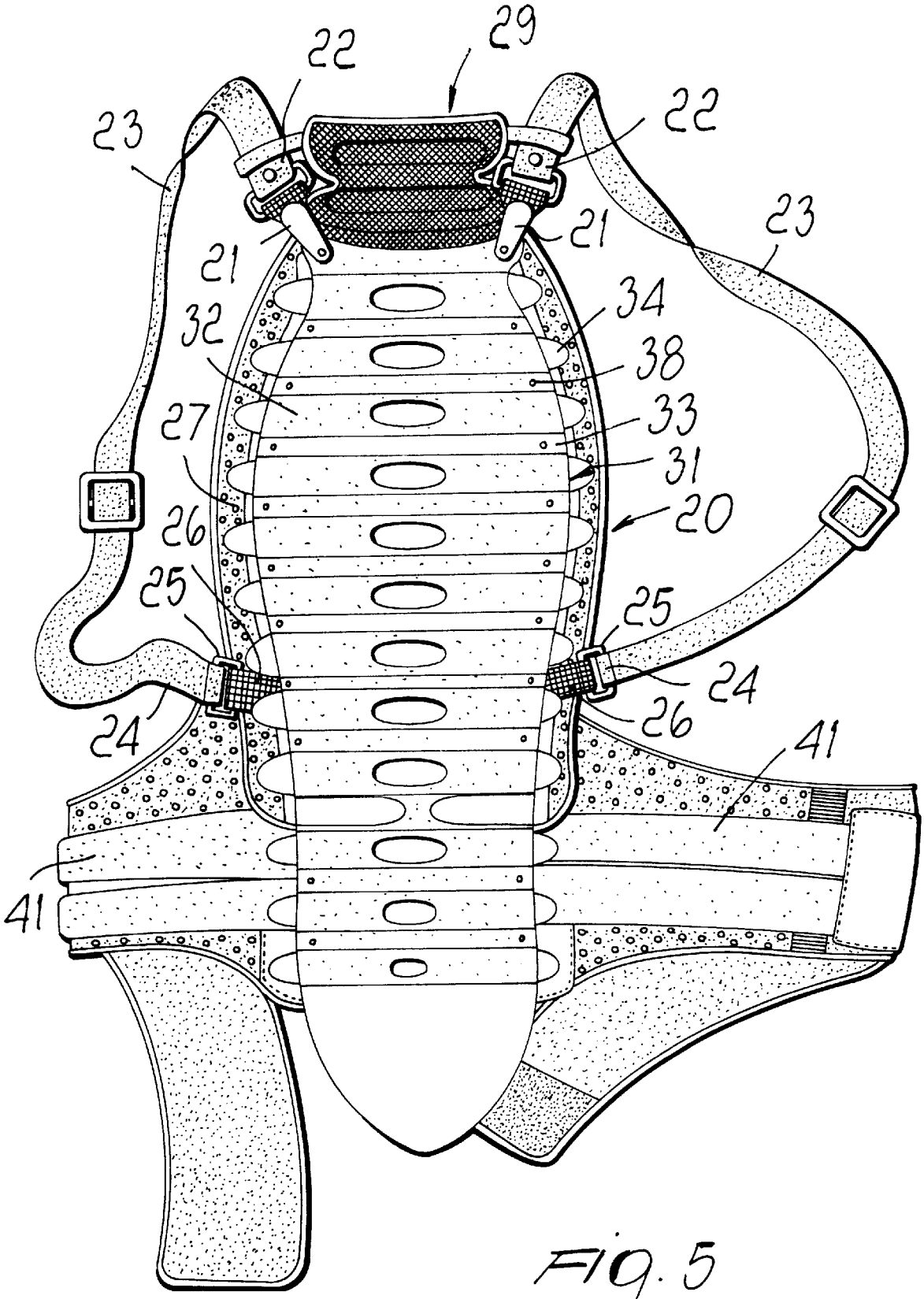
FIG. 5 is a front view of a variant of the protection shield of FIG. 1.
Figure 6:
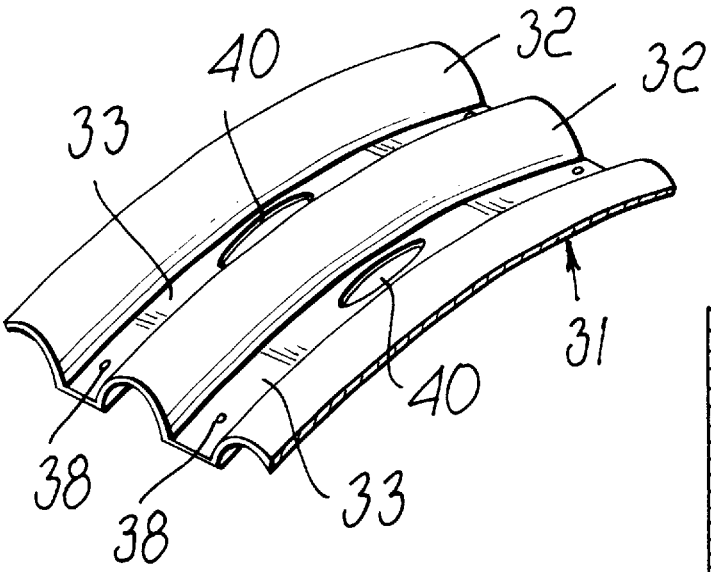
FIG. 6 shows a cross-section perspective view of the reinforcement element of the embodiment of FIG. 5.
Figure 7:
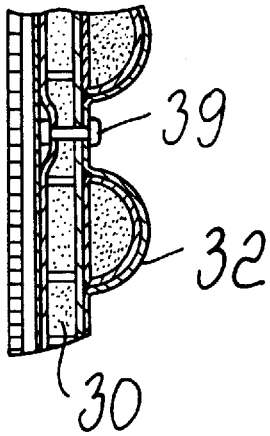
FIG. 7 shows a longitudinal section view of the protection shield of FIG. 5.
Figure 8:
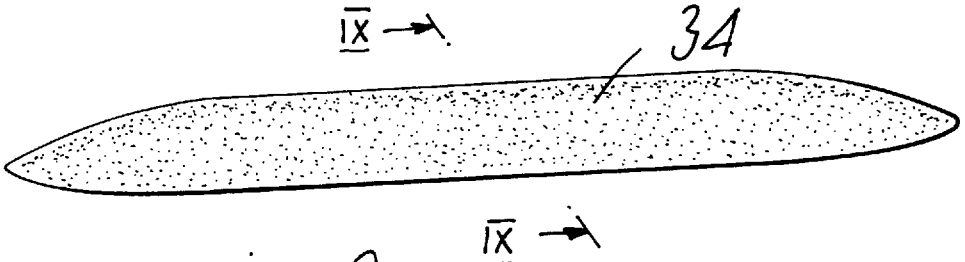
FIG. 8 is a perspective view of an impact cushioning pad.
Figure 9:
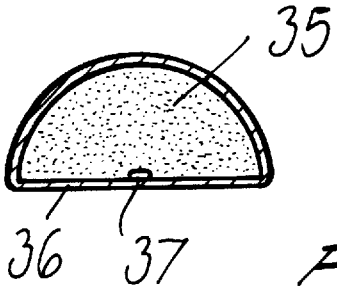
FIG. 9 shows a cross-section view of an impact cushioning pad taken along the line IX—IX of FIG. 8.

As shown in FIG. 5, it is in fact possible to join holes 19 to hooks 21 to which, in turn, the ends 22 of a pair of straps 23 are hooked.

The opposite ends 24 of the straps 23 are instead fixed to the lumbar region of the harness 20 by means of a ring 25 which is coupled to a strap 26 sewn directly onto the padding 27.

A substantially triangular rubber flap 28 is attached, e.g. by electric welding, to the lower end 15 of the element 1*b*, downstream of the transverse rib 16, and is flexible, thereby allowing a user to sit comfortably with no inconvenience due to the presence of protection device 1*b*, and resilient so as to cushion any impact at the sacrum portion.

With reference to FIGS. 5 to 9, according to another embodiment of the invention, a shield 29 comprises a smooth background 30 which is concave on its side designed to face against the user's back and has a silhouette which is similar to that of the above-described protection device 1*b*.

A reinforcement element 31 made of rigid material is superimposed on the background 30 and fixed thereto, e.g. by riveting; said reinforcement element has the same concavity as the background 30 to which it is coupled and has a series of equidistant humps 32 which are arranged transversely and alternated with flat portions 33.

The transverse humps 32 act as cages for locating elongated impact cushioning pads 34 which can contain open-cell polyurethane 35 or simply compressed air.

The impact cushioning pads 34 comprise an outer case 36 which is provided with a suitable inflation valve 37 in order to pressurize the interior, so that, in use, they act as cushioning elements for any impacts due to accidental falls in order to protect the backbone.

At the flat portions 33 and near to the lateral edges of the reinforcement element 31 there are, in case of coupling by means of riveting, holes 38 in which rivets 39 are inserted.

Each flat portion 33 of the reinforcement element 31 can also have a through opening 40 which is formed at the median portion thereof for lightening and perspiration purposes.

The entire shield 29 can be supported by a harness 20 provided with lumbar bands 41 designed to be closed around the user's waist and with shoulder straps 23 which are identical to those described above and required for keeping the shield 29 correctly placed upon the backbone.

The invention as described above is susceptible to numerous modifications and variations within the scope defined by the claims.

The disclosures in Italian Utility Model Application No. VR99U000048 from which this application claims priority are incorporated herein by reference.

What is claimed is:

1. A back protection shield for protecting user's backbone, constituted by at least one anatomic shell body made of substantially rigid material longitudinally extending so as to cover, in use, a substantial portion of a user's backbone, said shell body including a concave inner surface designed to face a user's back and a convex outer surface opposite to said inner surface, said at least one shell body comprising:

a first section constituting an upper shell body;

a second section constituting a lower shell body;

at least one series of stiffening ribs spaced from one another, said stiffening ribs extending at least partly in a transverse direction; and hinging means for joining said first and second sections so that the lower shell body is movable independently from said upper shell body, and wherein said hinging means are made of inserted, resiliently yieldable material, which is secured to said upper shell body at a first end thereof and to said lower shell body at a second end thereof.

2. The shield of claim 1, comprising two series of ribs which extend along two longitudinal lateral edges of the shell body.

3. The shield of claim 2, wherein said two series of ribs are transversely aligned with each other.

4. The shield of claim 3, wherein each rib of the rib series farms a transverse hump that delimits a traverse seat open towards said inner surface which comprises an impact cushion pad located therein.

5. The shield of claim 1, wherein the shell body has at least one through lightening opening thereby assisting perspiration and ventilation of user's back.

6. The shield of claim 5, comprising a plurality of though lightening openings in the form of holes with elliptical configuration aligned along a longitudinal median portion of the shield.

7. The shield of claim 1, wherein said inserted material is a rubber material which is injection-molded at said adjacent ends of said upper and lower shell bodies.

8. The shield of claim 7, wherein at least said upper shell body comprises a plurality of adjacent segments and a weakening portion between each pair of said adjacent segments, whereby said adjacent segments are adapted to perform slight mutual movements.

9. The shield as claimed in claim 8, wherein said weakening portions comprise a plurality of transversely aligned openings and connection points located been said openings for mutually connecting said segments.

10. The shield of claim 9, wherein said weakening portions are covered by inserted, resiliently yieldable material.

11. The shield of claim 1, wherein said shell body has at least one transverse wider portion at a scapular portion thereof, thereby protecting a wider back portion of the user's back upon impact against rigid and abrasive surfaces.

12. The shield of claim 1, wherein said shell body comprises two anatomical ends designed to protect cervical and sacral portions of user's backbone.

13. The shield of claim 12, wherein said two anatomical ends ate made of a highly deformable material.

14. The shield of claim 13, filter comprising two tabs projecting from an upper end of said shell body and shaped like an anatomic pad, the anatomical end designed for protection of the cervical portion is injection-molded on said two tabs.

15. The shield as claimed in claim 14, wherein the anatomical end designed for protection of the sacral portion of user's backbone comprises a substantially triangular tab.

16. The shield of claim 13, wherein said anatomical ends are made of rubber material.

* * * * *

UNITED STATES PATENT AND TRADEMARK OFFICE

CERTIFICATE OF CORRECTION

PATENT NO. : 6,427,695 B1
DATED : August 6, 2002
INVENTOR(S) : Pietro Zanetti et al.

It is certified that error appears in the above-identified patent and that said Letters Patent is hereby corrected as shown below:

Title page,
Item [30], should read: -- [30] Foreign Application Priority Data
Sep. 10, 1999 (IT) … … … … … … … … … … .. VR99000048U --

Signed and Sealed this

Eighth Day of April, 2003

JAMES E. ROGAN
*Director of the United States Patent and Trademark Office*